US005637843A

United States Patent [19]

Joyce et al.

[11] Patent Number: 5,637,843

[45] Date of Patent: Jun. 10, 1997

[54] ELECTROMECHANICAL PROGRAMMER/ TIMER

[75] Inventors: Ronald S. Joyce, Elk Grove Village; Daniel C. Johnson, Elburn; Robert R. Parotto, Algonquin, all of Ill.; Gordon B. Spellman, Mequon; Earl T. Piber, Oconomowoc, both of Wis.

[73] Assignee: Eaton Corporation, Cleveland, Ohio

[21] Appl. No.: 534,898

[22] Filed: Sep. 28, 1995

[51] Int. Cl.[6] ..... H01H 43/10

[52] U.S. Cl. ..... 200/38 R; 200/38 B

[58] Field of Search ..... 200/33 R–40, 200/283, 284

[56] References Cited

U.S. PATENT DOCUMENTS

| | | | |
|---|---|---|---|
| Re. 29,158 | 3/1977 | Cartier et al. | 200/38 B |
| 3,172,966 | 3/1965 | Holzer | 200/17 R |
| 3,725,618 | 4/1973 | Voland et al. | 200/38 C X |
| 3,809,831 | 5/1974 | Godwin et al. | 200/38 C |
| 3,819,886 | 6/1974 | Homan et al. | 200/38 B |
| 4,060,702 | 11/1977 | Linn | 200/35 R |
| 4,179,945 | 12/1979 | Obermann | 74/122 |
| 4,319,101 | 3/1982 | Bolin | 200/38 R |
| 4,381,433 | 4/1983 | Wagle | 200/38 R |
| 4,467,664 | 8/1984 | Willigman et al. | 74/116 |
| 4,500,212 | 2/1985 | Wojtanek | 368/108 |
| 4,536,626 | 8/1985 | Wojtanek | 200/35 R |
| 4,560,846 | 12/1985 | Klopp et al. | 200/38 R |
| 4,599,499 | 7/1986 | Duve | 200/35 R |
| 4,755,635 | 7/1988 | Willigman | 200/35 R |
| 5,290,978 | 3/1994 | Georgacakis et al. | 200/38 R |

*Primary Examiner*—J. R. Scott

*Attorney, Agent, or Firm*—Roger A. Johnston

[57] ABSTRACT

A cam disc has a dual row of ratchet teeth on the periphery for dual rate of advancement by either of two oscillating motorized advance pawls. The disc has alternating high and low concentric cam tracks formed on one face. A plate is registered on the cam disc hub and has integrally formed plural resilient cam follower arms with each arm having a plastic cam track follower tip molded over the tip. The molded tips make contact with a stationary portion of the plate to limit follower travel when the cam is retracted by user movement of the shaft for setting the cam position. The high and low cam tracks engage adjacent follower arm pairs to effect a drop-to-make and drop-to-break action to each of a plurality of SPDT switches disposed for actuation by the cam followers.

14 Claims, 8 Drawing Sheets

ELECTROMECHANICAL PROGRAMMER/ TIMER

BACKGROUND OF THE INVENTION

The present invention relates to programmer/timers of the type having a plurality of switches actuated in a timed sequence for controlling the operation of the various functions of an appliance. Programmer/timers of this sort are typically employed for controlling the program cycle of appliances such as automatic clothes washers and dishwashers. Such programmer/timers for clothes washers and dishwashers commonly employ a program cam which is advanced in timed relationship, for example, by an advance mechanism powered by a small subfractional horsepower timing motor to sequentially actuate the various function switches.

In the aforesaid time programmer/timers for clothes washers and dishwashers, the cam is commonly configured as a rotary drum which is initially positioned for selecting the length of the program by user rotation of a knob attached to the shaft upon which the cam is mounted. In a particularly widely used arrangement of household clothes washers and dishwashers, the knob is disposed to be either pushed or pulled in the axial direction for permitting rotation and setting of the program cam upon movement of the knob in one axial direction and energization of the programmer/timer by movement in the opposite axial direction. Users have become accustomed to this mode of control operation and it has achieved widespread acceptance in the marketplace for household appliances.

Heretofore, in the design and manufacture of programmer/timers for appliances, problems have been encountered in locating and positioning the cam followers for accurate timed sequencing for the actuation of the various switches. The tolerances accumulated in the manufacturing of the cam, the locating of the cam for rotation on the programmer/timer housing or base, and the tolerances in manufacturing the individual cam followers and locating the followers on the programmer/timer base or housing have made it difficult to achieve the desired program accuracy with a cam drum sized to fit the volume envelope available for the programmer/timer. Furthermore, the tolerances accumulated in manufacturing the individual components and the assembly of the advance mechanism have caused inaccuracies in the actuation of the individual switches and variations in the incremental advance of the cam by the advance mechanism which in turn results in further timing inaccuracies of the switches. Thus, in designing and manufacturing electromechanical programmer/timers for appliances, and particularly those employing a plurality of switches actuated by a sequentially advanced cam, the problem of positioning the program cam with respect to the switches has been formidable in view of the tolerance accumulation of the parts and the fact that more than one reference datum is employed for locating the cam followers and switches with respect to the cam.

Thus, it has been long desired to provide a simplified construction for an electromechanical programmer/timer which eliminates the inaccuracies due to tolerance accumulation in locating the switches with respect to the program cam.

Furthermore, in the aforesaid type electromechanical appliance programmer/timers, where a single pole double-throw (SPDT) type switching is required for each switch, it has been found quite difficult to control the accuracy of the switching of the side contacts where a rotary cam is employed for actuating the cam followers and switches. Where a cam drum employs a single cam track for each switch, it has been found difficult to provide for accurate making and breaking of the side contact with the single cam track. Heretofore, in the aforesaid type programmer/timers, and particularly where an SPDT switching action is desired, only the center or common contact has been moved to accomplish the switching of the side contacts. This has resulted in certain inaccuracies of switching and for which it has been desired to eliminate.

Heretofore, programmer/timers of the aforesaid type which have employed a plurality of cam tracks on a cylindrical surface to form a cam drum against which a switch cam follower rides on each of plural cam tracks formed about the drum. In this type of switching arrangement, in order for an SPDT switch to function, the center or common blade must follow the movement of the cam follower and thus slide against the friction of the cam ramp, or up the cam, to effect closing of one of the side contacts with the common contact blade whereupon the accuracy of the switching is a function of the spacing of the side contact from the common contact blade. The amount of cam motion and time is thus determined by the limit of the slope of ramp. Where one revolution of the cam drum represents a full or complete appliance program cycle, this necessarily limits the frequency of switch actuation which can be obtained for a given size or diameter of cam drum, for a given rate of cam advancement. In addition, known electromechanical programmer/timers for appliances, particularly those employed for household clothes washers and dishwasher machines which employ a plurality of rotary cam actuated switches, have exhibited the unwanted characteristic of being noisy when the user moves the knob axially to rotate the cam for selecting the starting position and program interval time. This is because, as the cam is rotated, the followers are moved to mechanically actuate and deactuate the switches despite the electrically de-energized state of the programmer/timer. It has thus also been desired to provide an economical way to disengage the cam from the followers to eliminate the noise of the switch actuation and deactuation during setting of the program cam by the user.

It has thus been long desired to provide a design for an electromechanical appliance programmer/timer which eliminated the foregoing drawbacks and disadvantages.

SUMMARY OF THE INVENTION

It is an object of the present invention to provide a electromechanical programmer/timer having a plurality of sequentially actuated cam operated switches and to minimize the inaccuracies of sequence timing caused by tolerance accumulations in positioning the cam followers with respect to the cam.

It is an object of the present invention to provide an electromechanical programmer/timer for an appliance having a plurality of appliance function switches sequentially actuated and deactuated by motorized advancement of a cam.

It is another object of the present invention to provide a programmer/timer for appliances in which the rotatable cam is moved out of engagement with the cam followers by axial movement of a user control knob attached to the shaft for the cam.

It is another object of the present invention to provide a cam operated electromechanical programmer/timer for appliances in which user movement of the control knob in one direction moves a shaft to engage the program cam with the cam followers and disengages the shaft from the cam to prevent rotation thereof by rotation of the user control knob.

It is another object of the present invention to provide an electromechanical programmer/timer having cam actuated switches of the single pole double-throw type wherein side contacts of each switch are closed by a dropping action of the cam follower on the cam.

It is another object of the present invention to provide a plurality of appliance function control switches actuated by advancement of a rotary cam and to improve the accuracy of the timing of the switch actuation and to reduce the relative manufacturing costs of the programmer/timer.

The present invention provides an electromechanical programmer/timer for appliances of the type employing a rotatable cam disc with a plurality of cam tracks provided on the axial face of the disc, which, upon advancement of the cam, effects sequential actuation and deactuation, through appropriate individual cam followers, of a plurality of appliance function control switches. The programmer/timer of the present invention employs a motor driven advance mechanism in the form of a spring loaded advance pawl which operates against ratchet teeth provided in the periphery of the cam disc.

The cam followers are formed integrally on a plate as a plurality of resiliently deflectable fingers having plastic tips molded thereover which tips each follow a cam track on one side of the disc. Movement of the advance pawl is limited by contacting a stationary portion of the plate thereby minimizing the effect of the accumulation of tolerances on the cam position with respect to the cam followers. Upon assembly of the invention during manufacture, the plate is registered against a hub portion of the cam disc which also minimizes the accumulation of tolerances and thereby improves the accuracy of location of the cam followers with respect to the cam tracks on the disc. The cam disc of the present invention is axially moveable toward or away from the cam followers by user movement of a shaft mounted control knob. A clutching mechanism engages the shaft with the cam upon movement of the cam away from the cam followers to permit user rotation of the cam for selecting a desired program interval with the cam followers disengaged from the cam. User movement of the shaft in the opposite axial direction disengages the clutch to prevent user rotation of the cam and engages the cam disc with the cam followers for switch actuation.

The incremental cam advance by the pawl contacting the ratchet teeth is limited by a limit stop on the follower plate which provides a reference to the cam followers. Contact of the molded plastic tips on each cam follower with the stationary portion of the follower plate prevents contact of the cam followers with the cam tracks when the cam disc is retracted by user movement of the shaft for engaging the clutch and rotation of the cam disc.

BRIEF DESCRIPTION OF THE DRAWINGS

FIG. 6 is an enlarged detail of one of the cam followers and switch assemblies of the embodiment of FIG. 1;

DETAILED DESCRIPTION

Figure 1:
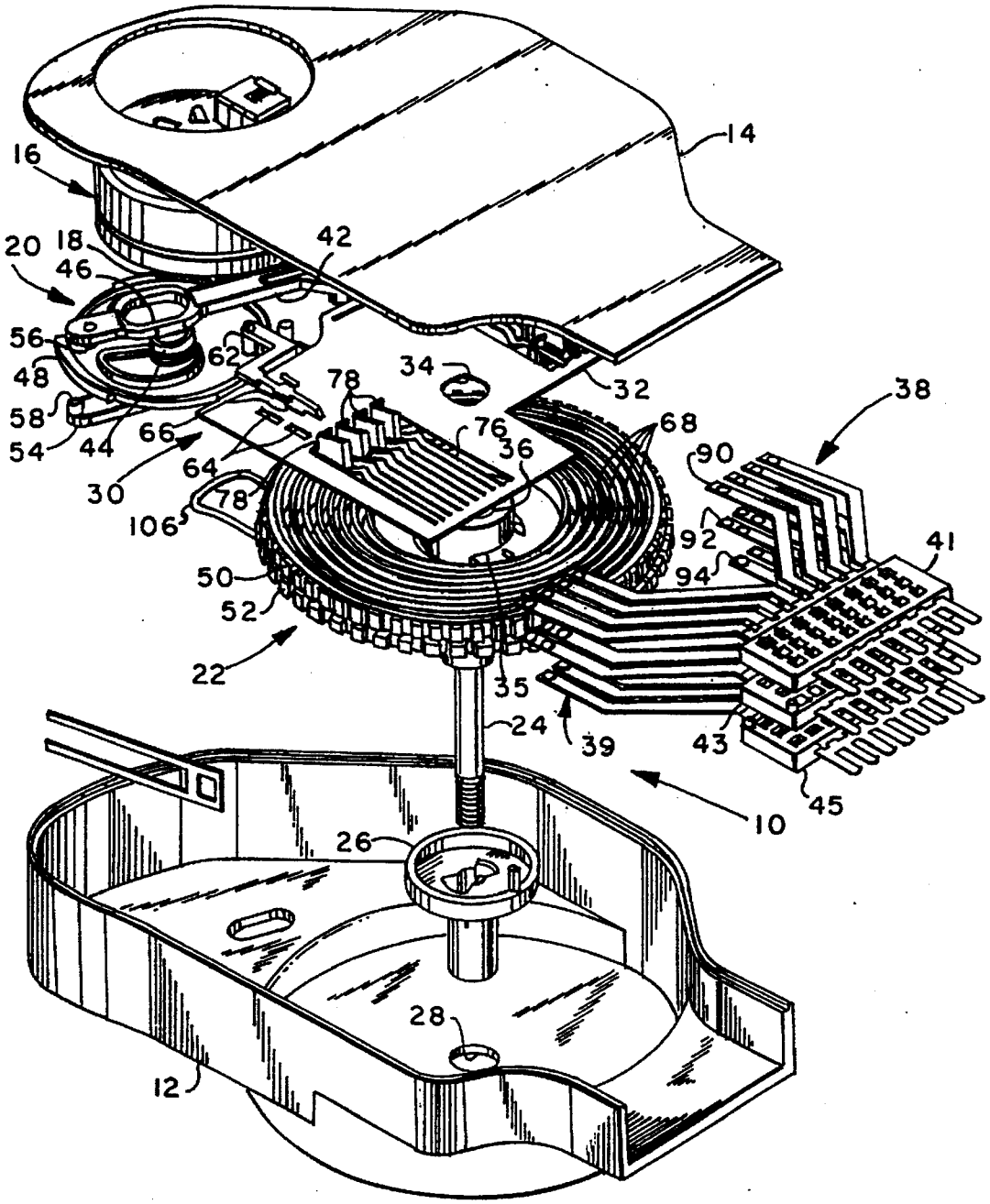
FIG. 1 is an exploded view of the programmer/timers of the present invention.
Figure 2:
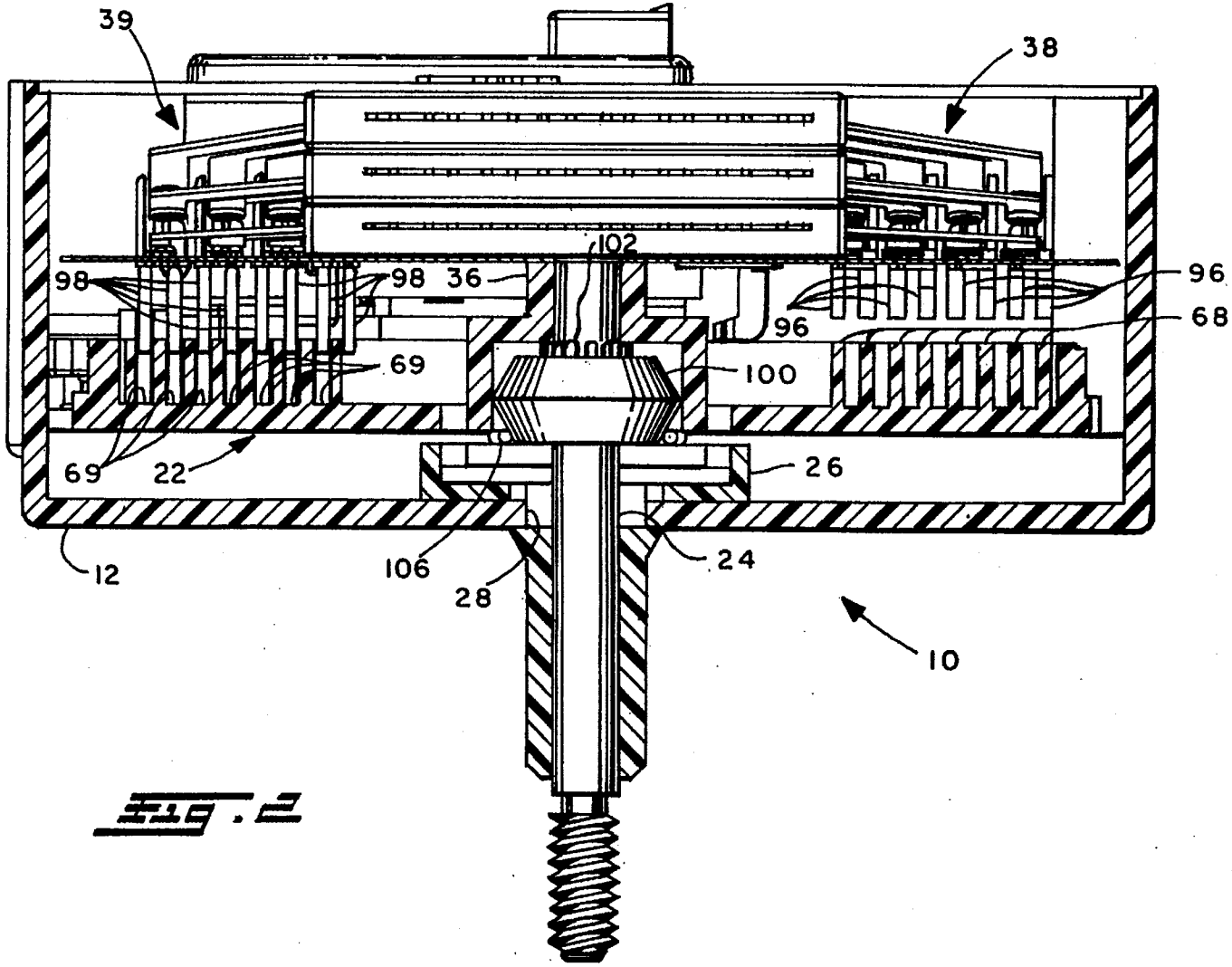
FIG. 2 is a cross-sectional view of the assembled invention of FIG. 1 with the cam disc retracted from the cam followers.
Figure 3:
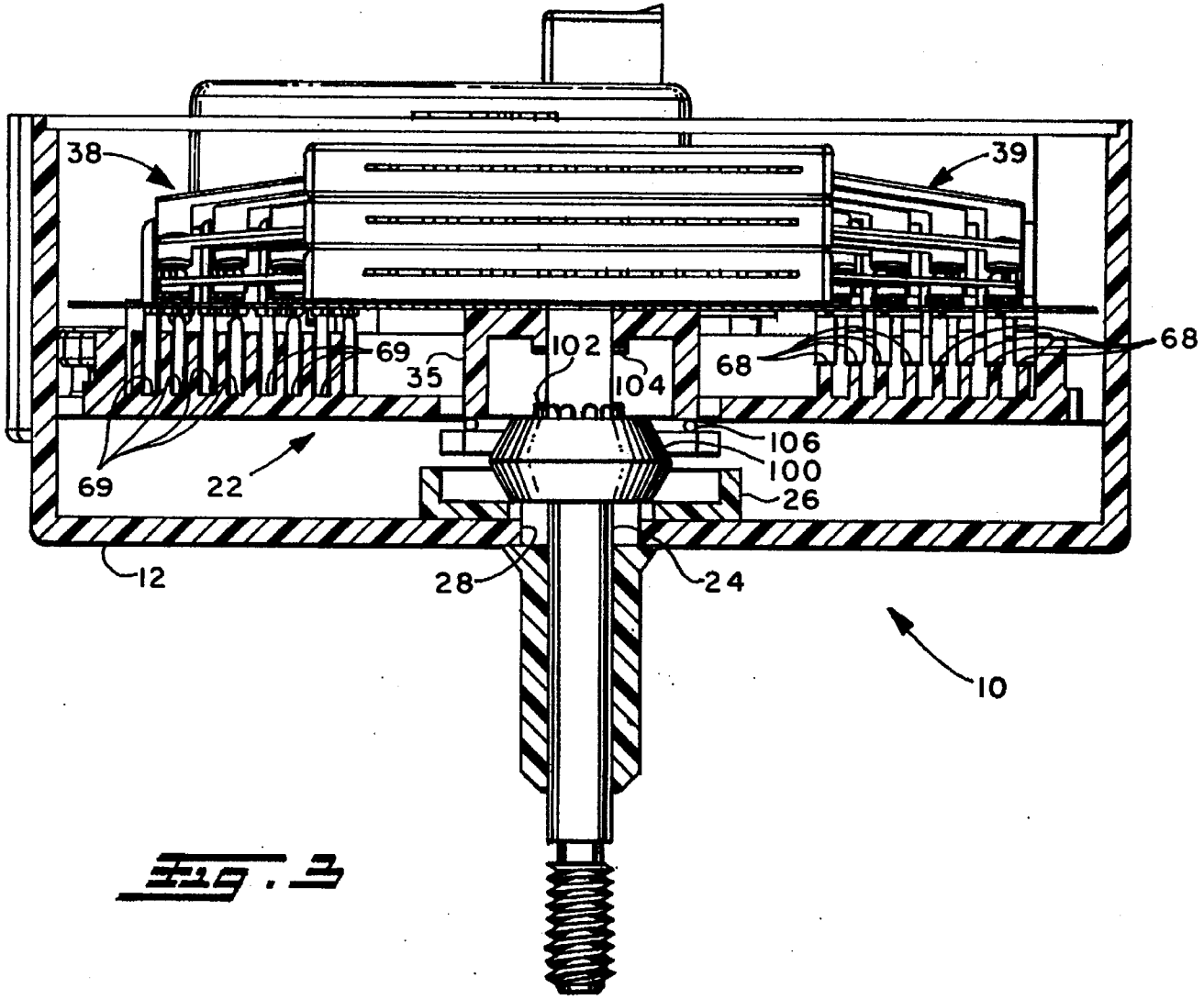
FIG. 3 is a view similar to FIG. 2 with the cam disc engaging the cam followers.

Referring to FIGS. 1, 2 and 3, the programmer/timer of the present invention is indicated generally at 10 as having a casing or housing 12 closed by a cover plate 14 and has a timing motor drive indicated generally at 16 which includes preferably a synchronous timing motor and speed reducing gears to drive an output shaft or hub 18 for operating an advance mechanism indicated generally at 20.

A cam means in the form of a disc indicated generally at 22 is rotatably mounted about shaft 24 which is received in a clutch hub 26 which is journalled through an aperture 28 in the case 12. Cam follower means indicated generally at 30 includes a plate member 32, which defines a plurality of cam followers, as will hereinafter be described, and which has an aperture 34 formed therein which is rotatably registered against a reduced diameter hub surface 36 provided on hub 35 of the disc 22.

A plurality of switch contact blade members indicated generally at 38 and 39 are mounted on the casing for actuation by the cam followers as will hereinafter be described in greater detail.

With reference to FIG. 1, it will be understood that the plurality of switch contact blades 38, 39 are individually molded in insulator blocks denoted by reference numerals 41, 43, 45.

Figure 5:
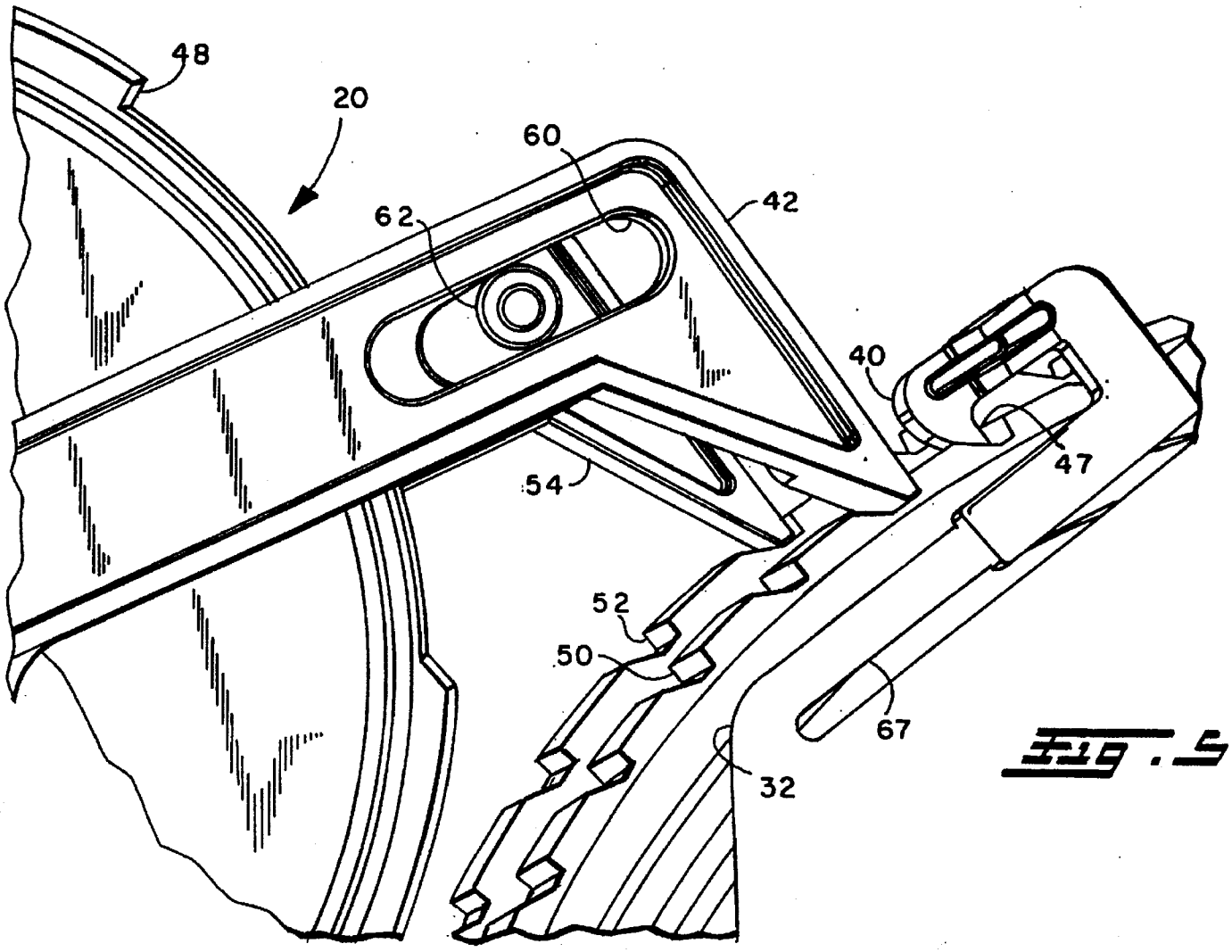
FIG. 5 is an enlarged detail of the advance pawl and cam ratchet of the embodiment of FIG. 1.
Figure 5:
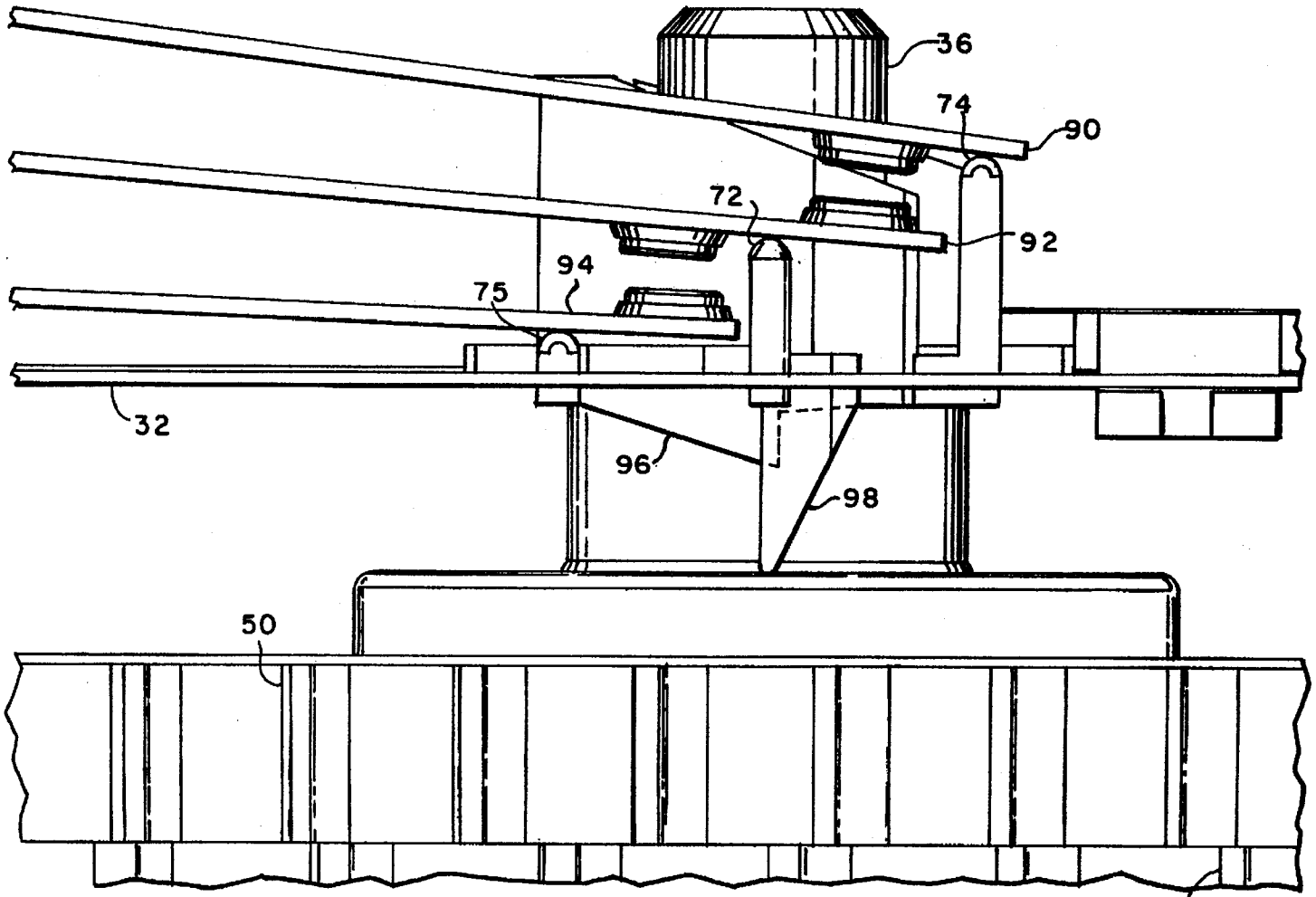

Referring to FIGS. 1 and 5, plate 32 has a limit stop 40 formed thereon which is operative to limit the travel or incremental cam advance. The advance mechanism 20 includes an advance pawl 42 driven by an eccentric 44 engaging a yoke 46 formed in the pawl 42. Preferably, a subinterval cam wheel 48 is provided for rotation with eccentric 44 and permits the actuation of a subinterval switching function.

Cam disc 22 has a dual row of peripheral ratchet teeth denoted by reference numerals 50, 52 formed peripherally thereabout with the row 50 having a higher or finer pitch than the row of teeth 52.

A second advance pawl 54 is provided on the opposite side of the subinterval cam 48 from the pawl 42 and is guided by the pawl 42 by a pin 56 formed on pawl 42 which engages a socket 58 on the pawl 54 formed adjacent the free end of the pawl. Referring to FIG. 5, pawl 42 has a slot 60 formed therein which is engaged by a pin 62 which extends from pawl 54 to align the pawl 54 and pawl 42 during advancement.

In the presently preferred practice, the pawl 54 effects a faster rate of advance by virtue of the teeth 50, 52 being circumferentially staggered and limit stop 40 only engaging the finer pitch ratchet teeth 50. When it is desired to have the slower advance ratchet teeth 50 operative, it will be understood that a segment of teeth 52 will be left missing to render advance pawl 54 inoperative.

Referring to FIG. 1, a subinterval switch actuator 62 engages the subinterval cam 48 and is guided for oscillation by slots 64 provided in the plate 32 which are engaged by suitable lugs 66 provided on the actuator 62. Actuator 62 engages a subinterval switch as will hereinafter be described in greater detail.

Referring to FIG. 5, a resilient arm 67 is formed on the plate 32 and has stop 40 molded thereover in a manner such as to engage the teeth 50 on the slow advance ratchet. Stop 40 has a generally chisel-shaped tooth 47 depending therefrom which engages teeth 50 of the ratchet. When the ratchet is advanced by the drive pawl, arm 67 is deflected to permit point 47 of stop 40 to ride up over teeth 50 and drop between teeth 50 to function as an anti-reverse stop for the ratchet during retraction of the drive pawl. During forward driving motion of pawl 42, the stop 40 limits the motion of the pawl.

Referring to FIGS. 1, 2 and 3, cam disc 22 has a plurality of concentric cam tracks 68 formed on the face thereof for effecting actuation of the switches as will hereinafter be described.

Figure 4:
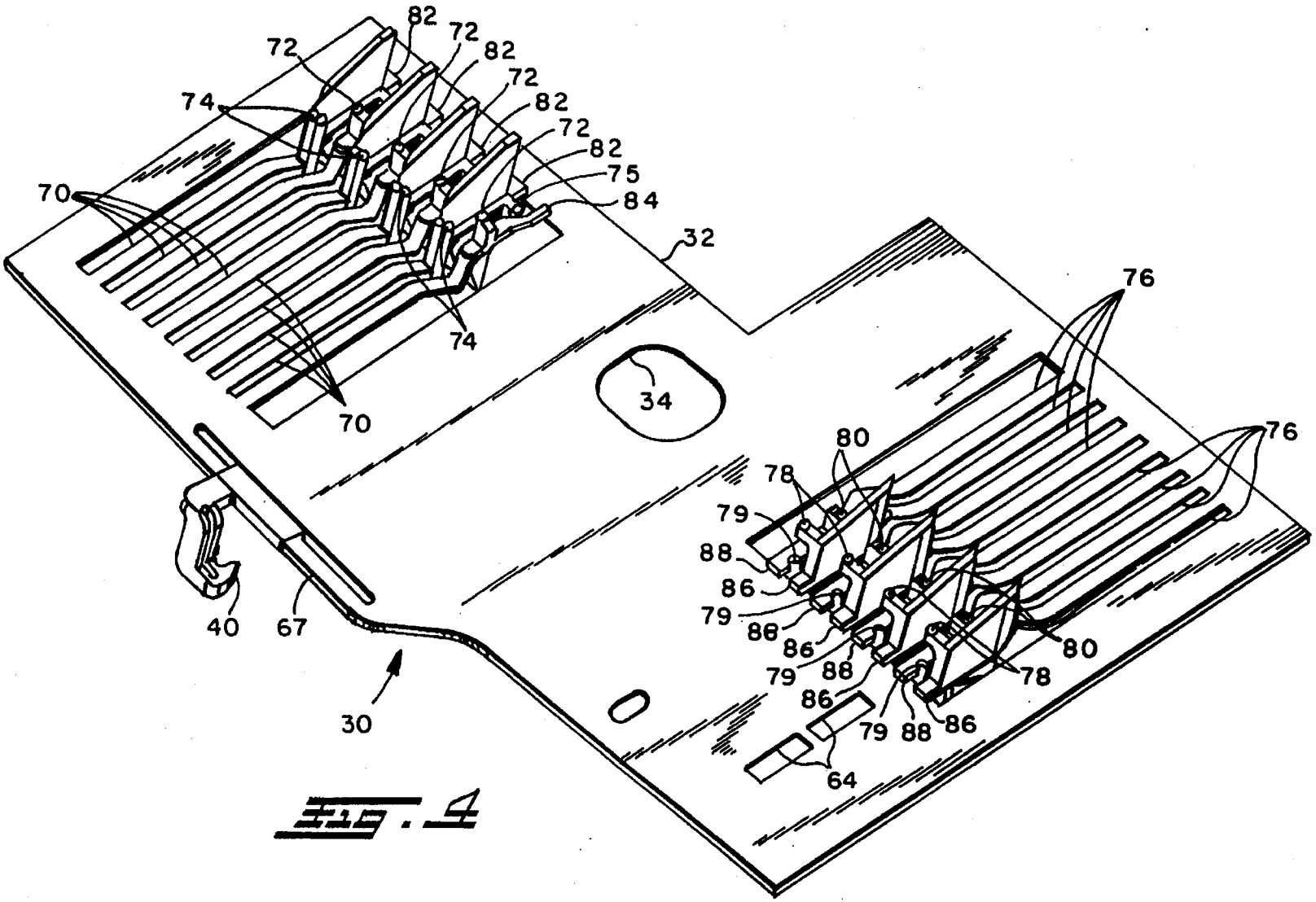
FIG. 4 is an axonometric view of the cam follower plate of the invention of FIG. 1.

Referring to FIG. 4, plate 32 has a plurality of resilient fingers denoted by reference numerals 70, 76 formed therein which are disposed in generally spaced parallel arrangement, each having the free end thereof provided with a plastic molded follower provided thereon with track follower surfaces as denoted by reference numerals 72, 74, 75 in FIG. 4.

Referring to FIGS. 4 and 6, it will be understood that each of the molded tips having the follower surfaces denoted by reference numeral 74 has molded integrally thereon a secondary lower level follower, one of which is visible in FIG. 4 and is denoted by reference numeral 75.

The cam followers 70 with their tips having follower surfaces 72, 74, 75 are disposed on plate 32 so as to be located on a generally common radial station of the cam disc 22 for each engaging the cam tracks 68, 69.

A second set of cam followers denoted by reference numeral 76 is formed on plate 32 on the opposite side of aperture 34 as the follower 70; and, followers 76 each have a plastic tip molded thereover which have thereon follower surfaces as denoted by reference numerals 78, 79, 80 in FIG. 4.

Referring to FIG. 4, each of the cam follower arms 76 having the molded tip with cam follower surfaces 78 thereon also has a lower level cam follower surface 79 provided thereon.

Each of the molded tips with follower surfaces 72, 74, 78, 80 has the end thereof provided with a tab denoted respectively by reference numerals 82, 84, 86, 88 which extend over the edge of the cut-out or void from which the resilient followers 70, 76 are formed in the plate 32, such that the tabs 82, 84, 86, 88 will contact the surface of the plate 32 to limit the deflection or travel of the resilient followers. It will be understood that the molded tips on followers arms 76 contact the cam tracks 68, 69 at a generally common radial station diametrically opposed from the tips 72, 74.

Referring to FIGS. 1 and 6, the plurality of switches 38, 39 are respectively disposed for actuation by the molded tips on arms 70, 76 wherein each of the switches comprises a center, upper and lower contact blade in SPDT arrangement as denoted typically for one of the switches by reference numerals 90, 92, 94.

Referring to FIGS. 1, 2 and 3, the cam disc 22 has the concentric radially spaced tracks 68 formed as raised tracks from the face of the disc; and, the spaces between the raised tracks 68 comprise the second set of radially spaced concentric cam tracks 69 which are generally coincident with the face of the disc as illustrated in FIGS. 2 and 3. It will be understood that alternating adjacent ones of the follower arms 70, 76 have the molded tips thereon formed to engage respectively the cam tracks 68, 69 so as to maximize the number of switches in the groups of switches 38, 39 which may be actuated by the single cam disc Referring to FIG. 6, a typical single pole double-throw switch set comprising the blades 90, 92, 94 is shown as being actuated by a pair of cam followers, typically the follower surfaces 74, 75 on one tip and follower surface 72 on an adjacent arm.

Referring to FIGS. 4 and 6, the follower surface 75 is shown as contacting the lower contact blade 94; the high level follower surface 74 contacting the undersurface of the upper contact blade 90; whereas, the follower surface 72 of an adjacent one of the follower arms 70 contacts the undersurface of the central contact blade arm 92.

The follower tip which includes the cam follower surfaces 74, 75 has molded integrally therewith a depending track follower denoted by reference numeral 96. The adjacent molded follower arm tip having the cam follower surface 72 thereon has integrally molded therewith a deeply depending track follower 98. It will be understood that the track follower 96 typically engages one of the cam tracks 68; whereas, the deep track follower 98 engages one of the cam tracks 69.

Referring to FIGS. 7 through 10, a typical switch from the group comprising the plurality of switches 38 is shown schematically as actuated by movement of adjacent ones of cam tracks 68, 69.

Figure 7:
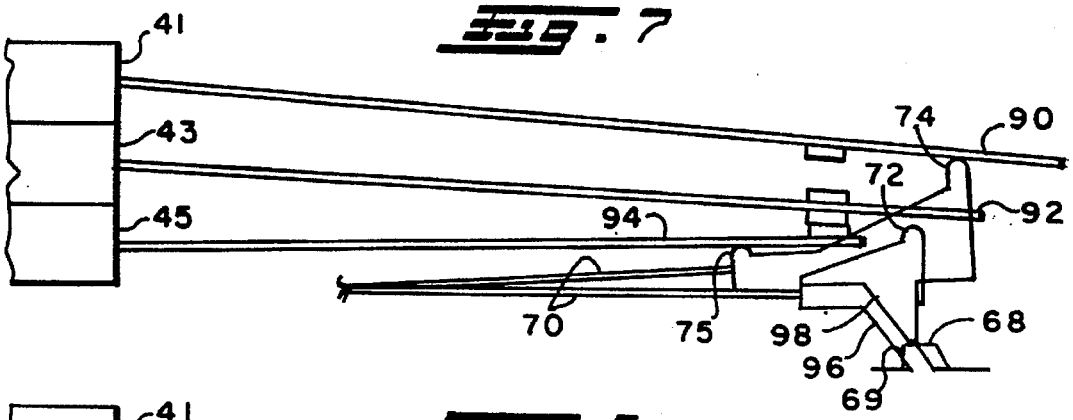
FIG. 7 is a schematic of a switch of the present invention with the center contact blade dropped to close the lower contact set.

Referring to FIG. 7, the switch is shown in the condition where cam track follower 98 has been lifted by cam track 69 to a position causing the follower surfaces 75 to lift lower switch blade 94 while cam follower surface 74 lifts the upper switch blade 90. Simultaneously, cam track follower 96 has been permitted to drop by cam track 68 causing cam follower surface 72 to permit the center contact blade 92 to drop thereby making contact between the contact blade 92 and blade 94.

Figure 8:
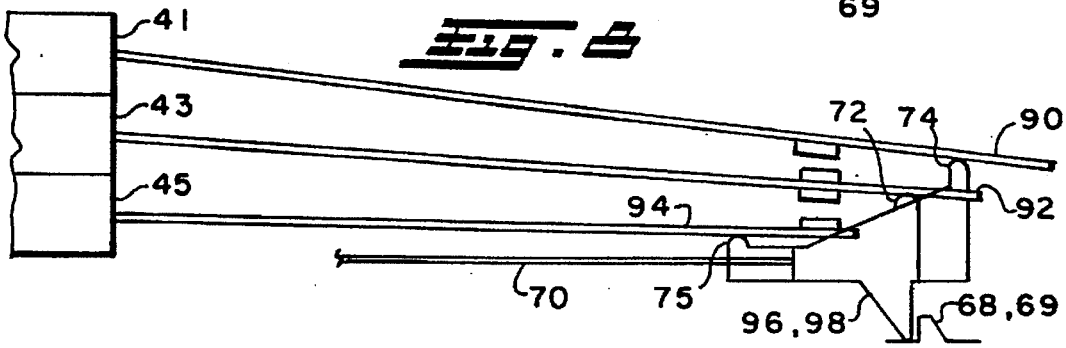
FIG. 8 is a schematic of the switch of FIG. 7 with the lower contact blade dropped to open the lower contact set.

Referring to FIG. 8, the switch of FIG. 7 is shown in the condition in which the cam track 69 has advanced sufficiently to allow the track follower 98 to drop to the same level as track 68 thus causing the follower surfaces 75 and 74 to drop, whereupon follower surface 75 lowers contact blade 94 sufficiently to break contact with blade 92 which is held by follower surface 72 with blade 90 being maintained above blade 92 by follower surface 74.

Figure 9:
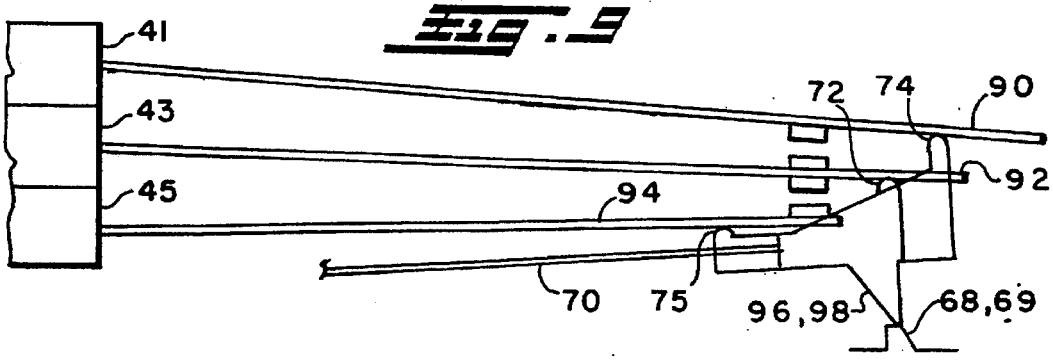
FIG. 9 is a schematic of the switch of FIG. 1 prior to dropping of the center contact blade.

Referring to FIG. 9, the cam tracks 68, 69 have been advanced from the position shown in FIG. 8 to a position raising track followers 96 and 98 thereby raising follower surfaces 75, 72, 74 and raising blades 94, 92, 90 while maintaining their relative positions of all blade contacts being in the open position.

Figure 10:
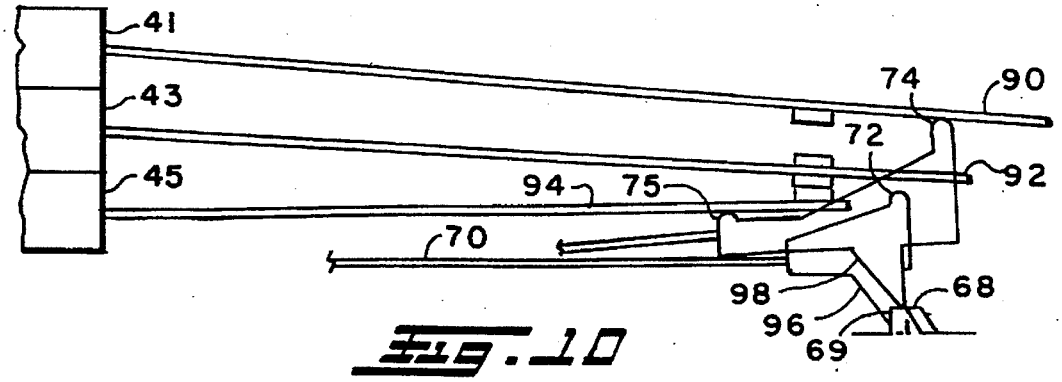
FIG. 10 is a schematic similar to FIG. 7 showing the cam moved from the position of FIG. 7 to re-close the lower contact set.

Referring to FIG. 10, the cam disc 22 has been further advanced from the position shown in FIG. 9 to a position similar to that of FIG. 7 wherein the cam track 68 has caused track follower 96 to drop thereby allowing contact blade 92 to make contact with blade 94 thus reclosing the lower switch of the SPDT arrangement.

Figure 11:
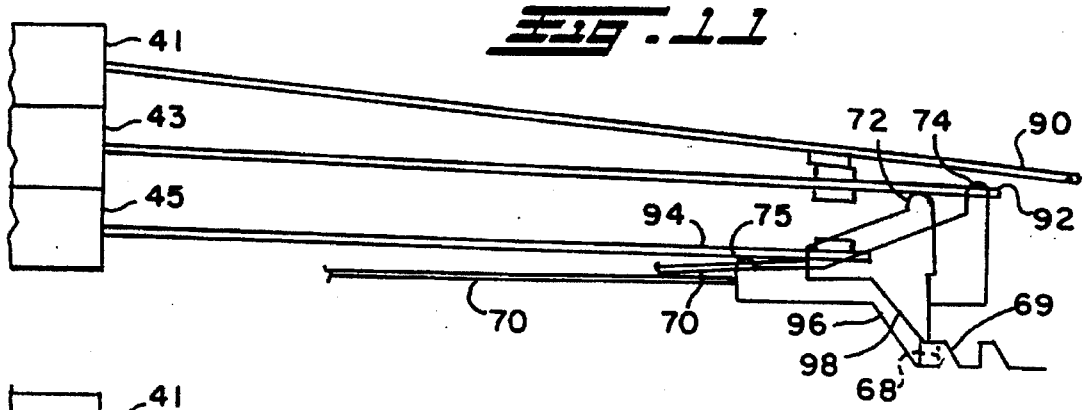
FIG. 11 is a schematic of the switch of FIG. 7 with the cam positioned to drop the upper and lower contact arms to close the upper contact set.

Referring to FIG. 11, a switch of the present invention is shown as having the cam track follower 96 lowered by cam track 68 thus causing follower surface 75 to lower blade 94 and follower surface 74 to lower blade 90. Simultaneously cam track 69 has caused track follower 98 to be raised causing follower surface 72 to raise blade 92 to contact the upper blade 90 thus closing the upper switch of the SPDT arrangement.

Figure 12:
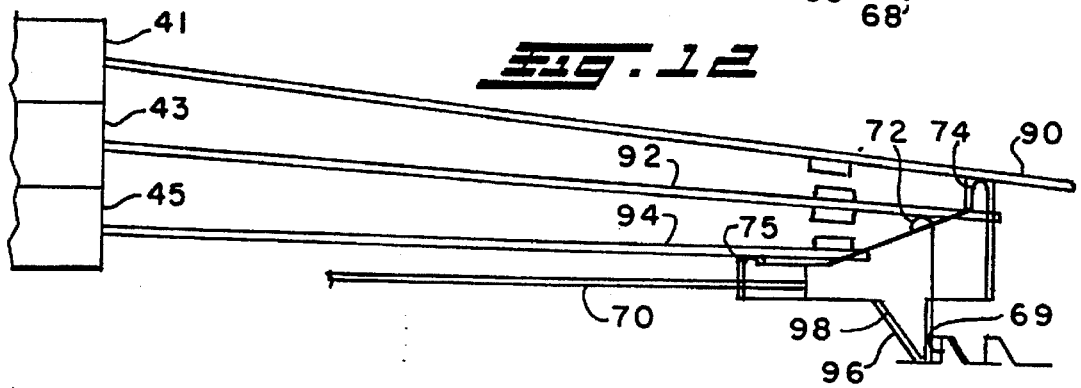
FIG. 12 is a schematic of the switch of FIG. 11 with the center contact arm dropped to open the upper contact set.

Referring to FIG. 12, the cam disc 22 has been advanced from the position shown in FIG. 11 to a position where cam follower 98 has been dropped by cam track 69 with track 68 maintaining follower 96 in the lowered position resulting in dropping of the center blade 92 to break contact with the upper blade 90 which is held up by follower surface 74.

Figure 13:
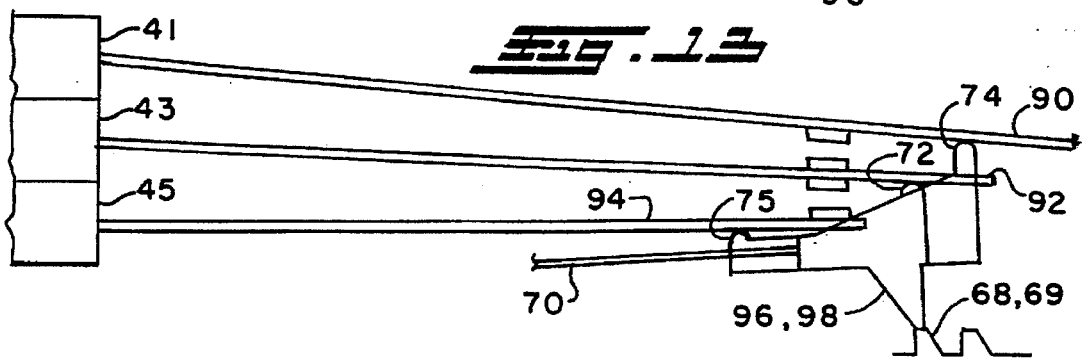
FIG. 13 is a schematic of the switch of FIG. 11 with the cam moved to a position immediately prior to dropping the upper contact blade arm; and, FIG. 14 is a schematic of the switch of FIG. 11 with the upper contact arm dropped to re-close the upper set of contacts.

Referring to FIG. 13, the cam disc 22 has been advanced further from the position of FIG. 12 to a position where cam tracks 68, 69 have raised both track followers 96, 98 to a position maintaining the relative open position of the contact blade arms with respect to each other as illustrated in FIG. 12, i.e., both upper and lower contact arms are separated from the center contact arm 92.

Figure 14:
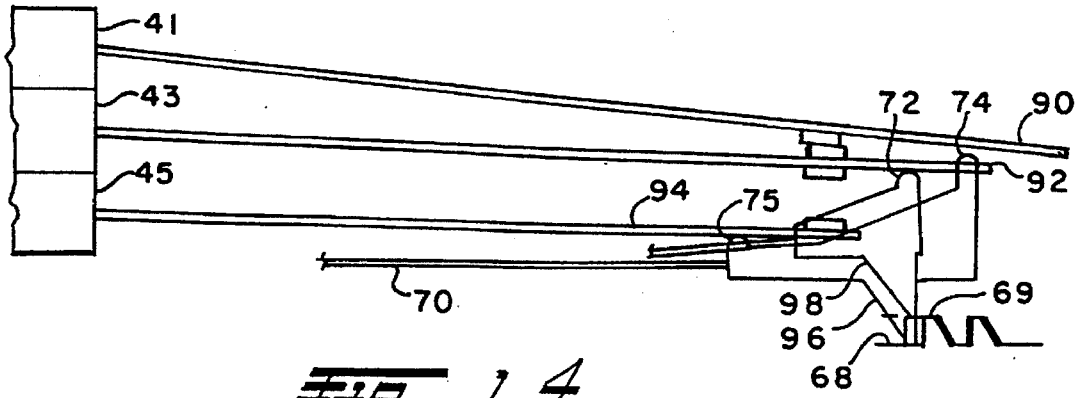

Referring to FIG. 14, the cam disc 22 has been advanced further from the position shown in FIG. 13 to a position where cam track 68 has dropped track follower 96 thus lowering follower surfaces 75 and 74 to lower blade 94 and to likewise lower upper blade 90. Simultaneously cam track 69 has been advanced to a position maintaining track follower 98 in a raised position where cam surface 72 and contact blade 92 may reclose with the upper contact 90, thus reclosing the upper switch of the SPDT arrangement.

Thus it will be seen from the above descriptions with respect to FIGS. 7 through 14, that both the upper and lower blade contact switches of the SPDT arrangement are actuated to close upon a dropping action of the cam which improves the accuracy of the switching and provides a more rapid closing of the respective switches.

Referring to FIGS. 1, 2 and 3, a further aspect of the invention is illustrated wherein a circular toggle or over-center disc 100 having a dual chamfered periphery is rigidly attached to the shaft 24 for movement therewith and includes a plurality of dog clutch teeth 102 which engage corresponding dog clutch teeth 104 formed on the interior of the hub 35 of the cam disc 22. A generally U-shaped spring member 106 is provided on the undersurface of the disc 22 and is engaged by the outer periphery of the toggle 100 upon axial movement of the shaft to provide a snap acting movement to the cam disc 22 upon axial movement of the shaft 24.

With reference to FIG. 2, the shaft 24 is shown moved into the upward position whereupon the largest diameter of the toggle member 100 has passed through spring 106 causing the chamfered surface of the toggle 100 to move the cam disc 22 downwardly with respect to the toggle causing dog clutch teeth 102 of the toggle to engage the dog clutch teeth 104 in the hub 35. It will be understood that when the cam disc 22 is moved to the downward position shown in FIG. 2, the cam tracks 68, 69 are disengaged from the track followers 96, 98 permitting the cam disc to be freely rotated by user rotation of shaft 24 without rotating disc 22 and without causing any of the cam tracks to actuate any of the switches 38, 39. This arrangement thus enables the user to move the shaft to the inward position with respect to the casing 12 and rotate the cam disc 22 for initial positioning to set the starting position of the switches 38, 39 with respect to the cam tracks 68, 69 and then re-engage the cam followers with the cam disc 22 by pulling the knob outward.

Referring to FIG. 3, the shaft 24 has been moved downwardly or outwardly with respect to casing 12 by the user movement such that the toggle 100 was passed downwardly through spring 106 causing the toggle to move the cam disc 22 upwardly to a position disengaging clutch teeth 104 from clutch teeth 102 and engaging the cam track 68 with the track followers for switches 39 and engage the track followers for the switches 38 with cam track 69. It will be understood that with the shaft and toggle in the position shown in FIG. 3, shaft 24 is freely rotatable within the cam disc; and, the cam disc is engaged with the drive pawl 42, 54 engaging ratchet teeth 50, 52 and the cam is advanced by operation of the advance mechanism.

Referring to FIG. 1, it will be understood that the subinterval switch actuator 62 is operative to engage one of the tabs 86, 88 in the plurality of cam followers 76 for providing a subinterval switching actuation for the respective selected one of the switches associated with the particular cam follower 76.

Although the invention has been described hereinabove with respect to the illustrated embodiments, it will be understood that the invention is capable of modification and variation and is limited only by the scope of the following claims.

We claim:

1. An electromechanical programmer/timer comprising:

(a) housing means having a motor associated therewith;

(b) cam means mounted for rotation about an axis on said housing means and having a rotary registration surface and a plurality of cam tracks thereon;

(c) advance means operably connected to said motor and effective for sequentially advancing said cam means;

(d) plate means having a first portion thereof defining a first surface in contact with said cam means registration surface, said plate means having second portions formed integrally thereon defining a plurality of spaced resilient cam followers;

(e) a plurality of switches associated with said housing means, with each of said switches disposed for actuation by one of said followers; and, (f) clutch means operable upon user movement in the direction of said axis for disabling said cam followers to permit rotation of said cam means without causing actuation of any of said switches.

2. The programmer/timer defined in claim 1, wherein said cam means includes a disc with a plurality of a cam tracks on a face thereof with at least one of said cam followers disposed to follow each cam track.

3. The programmer/timer defined in claim 1, wherein said advance means comprises a ratchet associated with said cams means and an oscillating pawl driving said ratchet.

4. The programmer/timer defined in claim 1, wherein at least one of said switches comprises a single pole double-throw (SPDT) switch and said cam means and follower means is operable to effect a drop to make and drop to break actuation for both side contacts of said SPDT switch.

5. The programmer/timer defined in claim 1, wherein said plate means second portion includes a plurality of spaced generally parallel resilient metal fingers with plastic tips molded thereon, said tips comprising said cam followers.

6. The programmer/timer defined in claim 1, wherein said plate means includes third portions defining stop means operable to limit the advancement of said advancement means.

7. The programmer/timer defined in claim 1, wherein said cam means registration surface is concentric with the axis of rotation of said cam means.

8. The programmer/timer defined in claim 1, wherein said advance means includes a ratchet wheel having a first set of ratchet teeth for advancement at a first rate and a second set of ratchet teeth having greater pitch than said first set for advancement at a second faster rate with predetermined intervals having no teeth and said advance means includes a first pawl engaging said first set of teeth and a second pawl engaging said second set of teeth, wherein said wheel is advanced at said first rate during said predetermined intervals of no teeth.

9. The programmer/timer defined in claim 1, wherein said plate means cam followers each has a tip molded thereon, said tips each operative to contact fourth postions of said plate means to limit movement of said followers.

10. The programmer/timer defined in claim 1, wherein said cam means is mounted on a shaft and includes clutch means operable upon user movement of said shaft in one axial direction to disengage said cam means from said follower means and to permit rotation of said cam means by user rotation of said shaft means, said clutch means operable to engage said cam means with said follower means upon subsequent user movement of said shaft means in the opposite axial direction and to permit free rotation of said shaft means with respect to said cam means.

11. The programmer/timer defined in claim 1, wherein said clutch means includes over center spring means.

12. The programmer/timer defined in claim 1, wherein said clutch means includes a splined connection between said shaft means and said cam means.

13. The programmer/timer defined in claim 1, wherein said plate means includes fourth portions thereof defining thereon a limit stop for said advance means.

14. The programmer/timer defined in claim 1, wherein said plate means includes anti-reverse means for said advance means.

* * * * *